US007781383B2

(12) United States Patent
Shiraishi et al.

(10) Patent No.: US 7,781,383 B2
(45) Date of Patent: Aug. 24, 2010

(54) LUBRICANT FOR FLUID DYNAMIC BEARING, SPINDLE MOTOR EQUIPPED THEREWITH AND MAGNETIC DISK UNIT

(75) Inventors: Takanori Shiraishi, Ehime (JP); Hideaki Ohno, Osaka (JP); Katsushi Hirata, Ehime (JP)

(73) Assignee: Panasonic Corporation, Osaka (JP)

( * ) Notice: Subject to any disclaimer, the term of this patent is extended or adjusted under 35 U.S.C. 154(b) by 1171 days.

(21) Appl. No.: 11/400,197

(22) Filed: Apr. 10, 2006

(65) Prior Publication Data

US 2006/0252658 A1 Nov. 9, 2006

(30) Foreign Application Priority Data

Apr. 11, 2005 (JP) ..... 2005-113827

(51) Int. Cl.
*C07D 233/14* (2006.01)
*C10M 135/06* (2006.01)

(52) U.S. Cl. ..... 508/283; 508/340

(58) Field of Classification Search ..... 508/283, 508/340

See application file for complete search history.

(56) References Cited

U.S. PATENT DOCUMENTS

2004/0033911 A1* 2/2004 Mikami et al. ..... 508/511

FOREIGN PATENT DOCUMENTS

| | | |
|---|---|---|
| JP | 2001-240885 | 9/2001 |
| JP | 2002-348586 | 12/2002 |
| JP | 2003-221588 | 8/2003 |
| JP | 2004-155873 | 6/2004 |

OTHER PUBLICATIONS

English language Abstract of JP 2001-240885.
English language Abstract of JP 2002-348586.
English language Abstract of JP 2003-221588.
English language Abstract of JP 204-155873.

* cited by examiner

*Primary Examiner*—Walter D Griffin
*Assistant Examiner*—Frank C Campanell
(74) *Attorney, Agent, or Firm*—Greenblum & Bernstein, P.L.C.

(57) ABSTRACT

A lubricant, comprising:
a base oil as primary lubricant component, and
a naphthenate salt as additive (A), and
an alkylimidazole compound as additive (B),
added to the base oil,
preferably further comprising an aliphatic amine compound as additive (C),
a fluid dynamic bearing with the lubricant filled therein, a spindle motor with the fluid dynamic bearing installed therein, and a magnetic disk device with the spindle motor installed therein.

18 Claims, 3 Drawing Sheets

LUBRICANT FOR FLUID DYNAMIC BEARING, SPINDLE MOTOR EQUIPPED THEREWITH AND MAGNETIC DISK UNIT

BACKGROUND OF THE INVENTION

1. Technical Field

The present invention relates to a lubricant for fluid dynamic bearing, a spindle motor equipped with a fluid dynamic bearing with the lubricant used therein, and a magnetic disk device equipped with the spindle motor.

2. Background Art

Fluid dynamic bearing have been used as a bearing for disk-driving spindle motor in information-recording device such as magnetic disk device (hard disk drive) In the recent growing demand for miniaturization of hard disk drive, there is a need for miniaturization of motor such as a spindle motor for driving magnetic disk. Shipment of small-sized hard disk drive is growing drastically, especially in the application for installation in potable small-sized audio recording/reproducing system, and will be so in applications such as in-car system and cellphone.

Small-sized hard disk drive in such applications are turned on and off more frequently than common hard disk drive installed in personal computer, and the motor therein repeats start up and shut down accordingly. In the fluid dynamic bearing installed in such a motor, the shaft therein occasionally becomes in contact with the metal supporting parts such as sleeve when the motor is turned on or off. It is thus inevitable that the shaft and the sleeve are worn away. It is necessary to reduce the wear loss as much as possible, to obtain a hard disk drive that satisfies requirements in performance such as rotational accuracy stable for an extended period of time.

An example of the conventional means for preventing wear of metal parts constituting the fluid dynamic bearing is a method of adding a phosphorus compound such as a phosphoric ester to the lubricant filled in fluid dynamic bearing (see e.g., Japanese Patent Application Laid-Open No. 2001-240885). The phosphorus compound forms an extreme-pressure film on metal surface, preventing the contact and reducing the wear between the metal parts. The extreme-pressure film is a film relatively softer than the metal that is formed in the reaction caused by frictional heat of an extreme-pressure agent such as a phosphorus compound with the newly-generated metal surface activated by wear.

Although there is a need for miniaturization of the fluid dynamic bearing along with miniaturization of motor, the amount of the lubricant used in bearing is smaller in small-sized fluid dynamic bearing. Some of the lubricant vaporizes in the fluid dynamic bearing during use at high temperature, and thus, decrease in the amount of the lubricant by vaporization exerts a significant influence on lifetime of the fluid dynamic bearing when the amount of the lubricant is smaller.

Vaporization of the lubricant seems to occur in the following way.

Some of the bonds in the molecular structure of organic compound commonly used as a base oil of the lubricant are cleaved by heat and oxidation, generating low-molecular weight compound. The compound vaporize easily because they have higher vapor pressures. In addition, the reaction generating the low-molecular weight compound is known to be accelerated by metal catalysis.

Small-sized hard disk drive, which are commonly operated at high rotational speed and becoming used more in in-car device, are used inevitably at a temperature higher than conventional disk drive. Portable device are often used outdoor under direct sun, and thus, may be operated at high temperature during use. For those reasons, it is quite important to improve heat resistance of the lubricant.

[Patent Document 1] Japanese Patent Application Laid-Open No. 2001-240885

[Patent Document 2] Japanese Patent Application Laid-Open No. 2002-348586

[Patent Document 3] Japanese Patent Application Laid-Open No. 2003-221588

[Patent Document 4] Japanese Patent Application Laid-Open No. 2004-155873

DISCLOSURE OF INVENTION

When a motor is miniaturized and used in a device higher in the repetition frequency of turning on and off, it is becoming more difficult to control wear of metal parts in the fluid dynamic bearing favorably by the method of adding an extreme-pressure agent such as a phosphoric ester described above to the lubricant in fluid dynamic bearing.

An object of the present invention is to provide a lubricant that reduces wear of metal parts in fluid dynamic bearing favorably even when used in small-sized fluid dynamic bearing demanding higher wear resistance such as those used in hard disk drive application in portable device.

The present invention relates to a lubricant, comprising:

a base oil as primary lubricant component, and a naphthenate salt as additive (A), and an alkylimidazole compound as additive (B), added to the base oil, preferably comprising an aliphatic amine compound as additive (C).

DETAILED DESCRIPTION OF THE INVENTION

Figure 1:
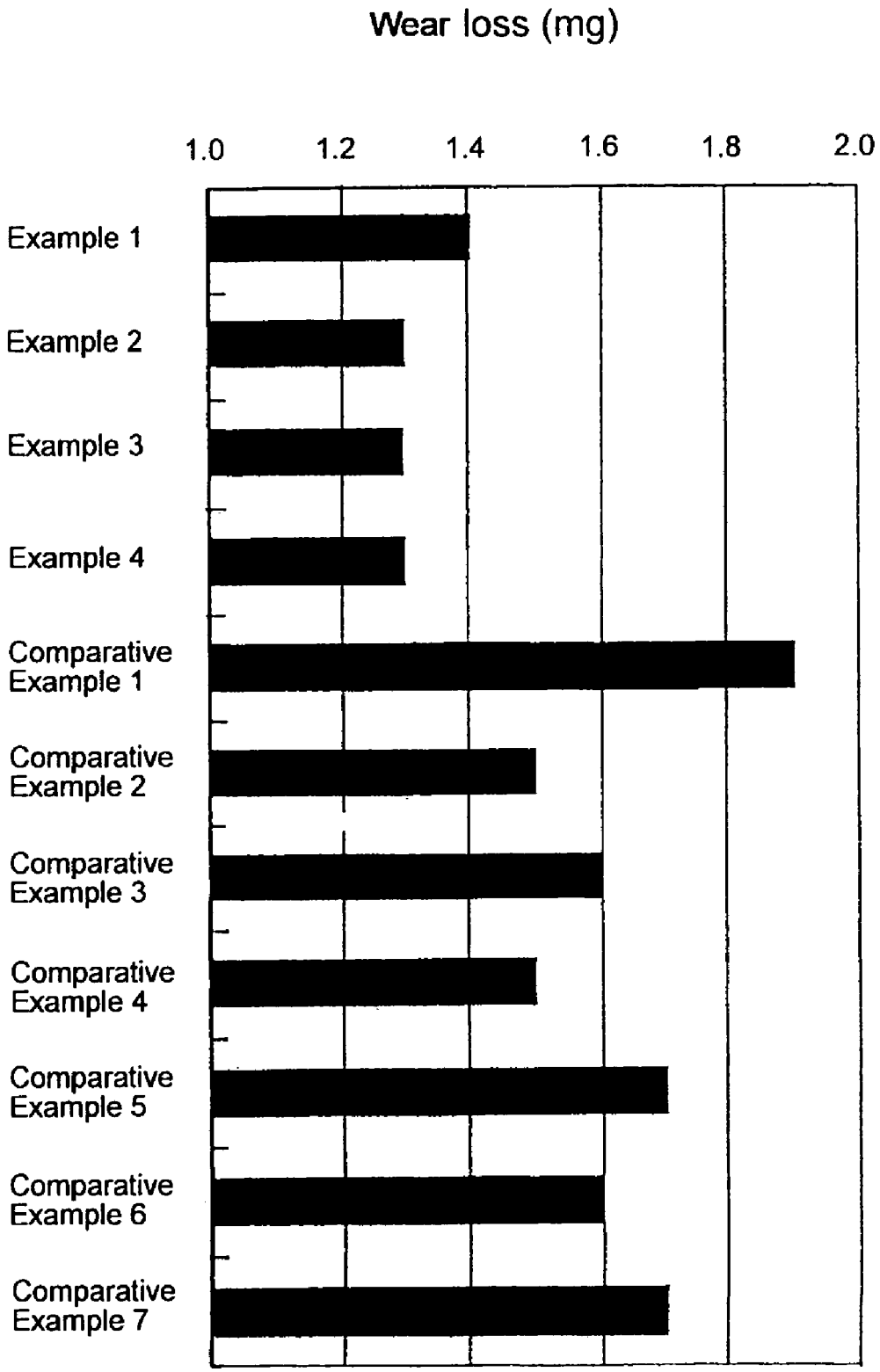
FIG. 1 is a graph comparing wear loss of lubricants according to the present invention of Examples 1 to 4 with that of lubricants of Comparative Examples 1 to 7.

The lubricant according to the present invention comprises a base oil as primary lubricant component and a naphthenate salt as additive (A) and an alkylimidazole compound as additive (B) that are added to the base oil.

In the fluid dynamic bearing using the lubricant according to the present invention, an extreme-pressure film seems to be formed on metal surface in the reaction caused by frictional heat between the additive (A) naphthenate salt and the newly-generated metal surface activated by wear. A reaction-product film seems to be formed additionally on metal surface in the reaction between the imidazole group in additive (B) alkylimidazole compound and the metal. A dense and strong film seems to be formed on metal surface by the synergic effects of a particular combination of the extreme-pressure film and reaction-product film, such as covering the wide area of the metal surface complementarily with the extreme-pressure film and the reaction-product film, and forming a laminated film of the extreme-pressure film and the reaction-product film. Thereby, lubricity increases and the contact between metal parts is suppressed, resulting in reduction of wear.

The lubricant according to another aspect of the present invention comprises a base oil as primary lubricant component, and a naphthenate salt as additive (A), an alkylimidazole compound as additive (B), and an aliphatic amine compound as additive (C), added to the base oil.

In a fluid dynamic bearing using the lubricant according to the present invention, an extreme-pressure film seems to be formed on metal surface in the reaction caused by frictional heat between the additive (A) naphthenate salt and the newly-generated metal surface activated by wear. A reaction-product film seems to be formed additionally on metal surface in the reaction between the imidazole group in the additive (B) alkylimidazole compound and the metal. The polar amino group seems to be adsorbed on metal surface electrostatically when the additive (C) the aliphatic amine compound become in contact with the metal surface. A dense and strong film seems to be formed on metal surface by the synergic effects of a particular combination of the extreme-pressure film and reaction-product film and adsorption film, such as covering the wide range of the metal surface complementarily by the extreme-pressure film, the reaction-product film and the adsorption film, and forming a laminated film of the extreme-pressure film, the reaction-product film and the adsorption film. Thereby, lubricity increases and the contact between metal parts is suppressed, resulting in reduction of wear.

The fluid dynamic bearing according to the present invention is filled with the lubricant according to the present invention. The spindle motor according to the present invention is equipped with the fluid dynamic bearing above. The magnetic disk device according to the present invention uses the spindle motor above.

ADVANTAGEOUS EFFECT OF THE INVENTION

The lubricant according to the present invention containing a base oil and the additives (A) and (B), preferably as well as the additive (C), shows a characteristic synergic effect, and reduces wear among metal parts in fluid dynamic bearing more effectively than that containing only a conventional phosphorus compound. Thus, it is possible to improve reliability of hard disk drive that is turned on and off frequently when it is used as lubricant for the fluid dynamic bearing in a motor of hard disk drive.

Further, addition of the additives (A) and (B), preferably as well as the additive (C), suppresses deterioration of the lubricant by catalytic action of the metal and reduces the vaporization amount of the lubricant, resulting in elongation of life of the motor using the fluid dynamic bearing.

BEST MODE OF CARRYING OUT THE INVENTION

Hereinafter, the most favorable embodiments of the present invention will be described.

The lubricant according to the present invention employs, as base oil, at least one compound selected from poly-α-olefin compound, ester compound, ether compound, fluorine compound, alkylbenzene compound and the like.

An additive (A) naphthenate salt and an additive (B) alkylimidazole compound are added to the base oil as essential components.

Preferably, an additive (C) aliphatic amine compound is added, in addition to the additives (A) and (B).

Typical examples of the additive (A) naphthenate salt include lithium naphthenate, magnesium naphthenate, aluminium naphthenate, calcium naphthenate, manganese naphthenate, cobalt naphthenate, copper naphthenate, zinc naphthenate, barium naphthenate, lead naphthenate, and the like. Among them, zinc naphthenate is preferable because it is higher in extreme-pressure properties and lower in environment load.

Typical examples of the additives (B) and (C) are respectively an additive (B1) 2-straight-chain-alkylimidazole compound and an additive (C1) primary amine compound.

Typical examples of the additive (B1) 2-straight-chain-alkylimidazole compound include 2-methylimidazole, 2-ethylimidazole, 2-propylimidazole, 2-butylimidazole, 2-pentylimidazole, 2-hexylimidazole, 2-heptylimidazole, 2-octylimidazole, 2-nonylimidazole, 2-decylimidazole, 2-undecylimidazole, 2-dodecylimidazole, 2-tridecylimidazole, 2-tetradecylimidazole, 2-pentadecylimidazole, 2-hexadecylimidazole, 2-heptadecylimidazole, 2-octadecylimidazole, and the like. Among them, 2-undecylimidazole is preferable, because it is superior in usability and film-forming efficiency.

Typical examples of the additive (C1) primary amine compound include decylamine, undecylamine, dodecylamine, tridecylamine, tetradecylamine, pentadecylamine, hexadecylamine, heptadecylamine, octadecylamine, and nonadecylamine. Among them, octadecylamine is preferable because it is higher in usability and film-forming efficiency.

The addition amounts of the additives above are respectively as follows: The following addition amounts (wt %) are values (wt %) with respect to the total amount of the lubricant. The same shall apply also in Examples.

The amount of the additive (A) naphthenate salt added is preferably 0.1 to 5 wt %, more preferably 0.5 to 2 wt %.

The amount of the additive (B) alkylimidazole compound added is preferably 0.01 to 2 wt %, more preferably 0.05 to 0.5 wt %.

The amount of the additive (C) aliphatic amine compound added is preferably 0.01 to 2 wt %, more preferably 0.05 to 0.5 wt %.

When the addition amount of these additives according to the present invention is lower than the lower limit value, it is not possible to suppress wear effectively. The addition amount higher than the upper limit value is also unfavorable, because it is disadvantageous economically and the additive occasionally precipitates at low temperature of room temperature or lower because of its limited solubility although there is wear-suppressing effect.

It is preferable to add one or more antioxidants for prevention of oxidation of the base oil. Any known compound may be used as antioxidant. Specifically, phenol- or amine-based antioxidants containing no sulfur or chlorine are preferable. Among them, phenol-based antioxidants higher in heat resistance that contain two or more phenol groups are preferable. In such a case, combined use of an amine-based antioxidant is preferable because of its possible synergic effect. The amount of the antioxidant added is preferably 0.01 to 5 wt %. An amount of less than 0.01% is almost ineffective in suppressing oxidation. An amount of more than 5% is unfavorable, because it is disadvantageous economically and the additive occasionally precipitates at low temperature of room temperature or lower because of its limited solubility in the lubricant although there is wear-suppressing effect. The amount of the antioxidant added is more preferably 0.05 to 2 wt %.

It is also possible to add, as needed, other additives such as oiliness improver, extreme-pressure agent, friction modifier, anti-wear agent, rust inhibitor, corrosion inhibitor, metal deactivator, detergent-dispersant, viscosity index improver, conductivity enhancing agent, and hydrolysis inhibitor. These additives are known compounds used for improving and strengthening the properties of the base oil, and selected as needed.

Example 1

The lubricant according to the present invention in Example 1 will be described below.

The lubricant of Example 1 contains an ester compound dioctyl sebacate (hereinafter, referred to as DOS) as base oil. The following compounds are added to DOS as additive.

Example 1: 1 wt % of a naphthenate salt zinc naphthenate and 0.1 wt % of 2-straight-chain-alkylimidazole compound 2-undecylimidazole are added to the base oil.

Examples 2 to 4

The lubricants according to the present invention in Examples 2 to 4 will be described below.

The lubricants in Examples 2 to 4 contain DOS as base oil. The following compounds are added to DOS as additive.

Example 2: 1 wt % of a naphthenate salt zinc naphthenate, 0.1 wt % of a 2-straight-chain-alkylimidazole compound 2-undecylimidazole, and 0.1 wt % of a primary amine compound octadecylamine are added to the base oil.

Example 3: 2 wt % of a naphthenate salt zinc naphthenate, 0.1 wt % of a 2-straight-chain-alkylimidazole compound 2-undecylimidazole, and 0.1 wt % of a primary amine compound octadecylamine are added to the base oil.

Example 4: 1 wt % of a naphthenate salt zinc naphthenate, 0.5 wt % of a 2-straight-chain-alkylimidazole compound 2-undecylimidazole, and 0.5 wt % of a primary amine compound octadecylamine are added to the base oil.

The wear resistance of the lubricants of Examples 1 to 4 and the following lubricants of Comparative Examples 1 to 7 was determined by the Falex test well known to those skilled in the art. ϕ5-mm SUS420 shaft and a Ni-plated brass V block were used in the Falex test. This combination is one of examples of combination that is the same as that of the materials used in fluid dynamic bearing. The shaft is rotated while a load of 10 kg is applied to the V block. The number of revolutions of the shaft is 300 rpm, and the test period is 3 hours.

The wear loss was determined from the difference in the total weight of the shaft and V block between before and after the test.

The compositions of the lubricants of Comparative Examples 1 to 7 are as follows: The base oil used is all DOS.

Comparative Example 1: only base oil.

Comparative Example 2: 1 wt % of a phosphoric ester compound trioctyl phosphate is added to the base oil.

Comparative Example 3: 1 wt % of zinc naphthenate is added to the base oil.

Comparative Example 4: 2 wt % of zinc naphthenate and 0.1 wt % of octadecylamine are added to the base oil.

Comparative Example 5: 0.1 wt % of 2-undecylimidazole is added to the base oil.

Comparative Example 6: 0.1 wt % of 2-undecylimidazole and 0.1 wt % of octadecylamine are added to the base oil.

Comparative Example 7: 0.1 wt % of octadecylamine is added to the base oil.

For evaluation of the effect of suppressing metal catalysis activity by the additives, the vaporization amount of the lubricant, as an indicator of the deterioration of lubricant, was determined by the following method:

Ten gram of each lubricant of Examples 1 to 4 and Comparative Examples 1 to 7 is placed in a ϕ50-mm dish. Ten gram of SUS420 powder is immersed in each lubricant dish and left at a constant temperature of 150° C. for 48 hours. The total weight of the lubricant and the SUS420 powder in each dish is determined after 48 hours. The amount of evaporation was determined from the difference in the total weight between before and after the test.

Figure 2:
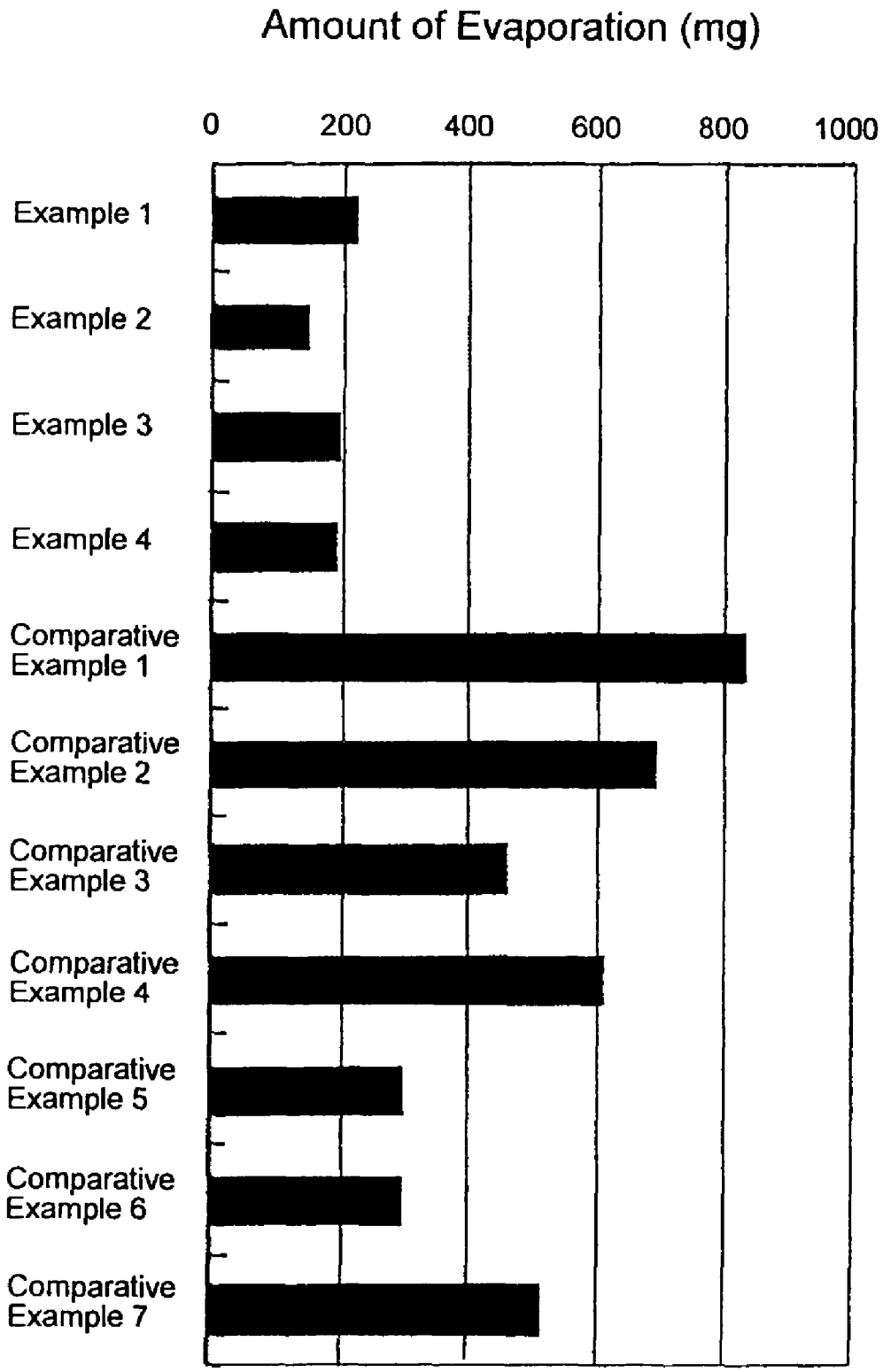
FIG. 2 is a graph comparing vaporization amount of lubricants according to the present invention of Examples 1 to 4 with that of lubricants of Comparative Examples 1 to 7.

The wear loss and the amount of evaporation obtained in the two tests are shown in bar charts of FIGS. 1 and 2. FIG. 1 shows the wear loss (unit: mg), while FIG. 2 shows the amount of evaporation (unit: mg).

Even if multiple additives each having a film-forming potential are added, normally only one of them, which is most active on the metal surface, is effective. However, as apparent from FIGS. 1 and 2, the wear loss and the amount of evaporation of the lubricants of Examples 1 to 4 are lower than those of the Comparative Examples 1 to 7. The results seem to be because of the synergic effect that occurs only in the combinations of the present invention. Among the lubricants of Examples 1 to 4, the lubricant of Example 2 is the lowest both in wear loss and amount of evaporation.

When metal parts are lubricated by using the lubricant according to the present invention, each additive therein seems to exhibit the following lubrication action.

The action of zinc naphthenate seems to be the followings. Zinc naphthenate forms an extreme-pressure film on metal surface in the reaction caused by frictional heat with the newly-generated metal surface activated by wear. Presence of the extreme-pressure film between two sliding metal parts prevents direct contact between the metal parts, so that seizure is suppressed and that wear is prevented.

The action of 2-undecylimidazole seems to be the followings. 2-undecylimidazole forms a reaction-product film in reaction of its imidazole group with the metal.

The action of octadecylamine seems to be the followings. Octadecylamine forms a film on metal surface when in contact with the metal surface, as polar amino group in octadecylamine is adsorbed on the metal surface electrostatically.

The lubricant according to the present invention seems to form a dense and strong film on metal surface by the synergic effect in a particular combination of the extreme-pressure film by additive (A) with the reaction-product film by additive (B), so that the contact between the metal parts are suppressed and wear is reduced.

When there is an adsorption film by additive (C) in addition to the extreme-pressure film by additive (A) and the reaction-product film by additive (B), the lubricant seems to form a denser and stronger film on metal surface by the synergic effect of the particular combination, so that the contact between the metal parts are suppressed and wear is reduced.

Because a dense and strong film is formed on metal surface with the lubricants according to the present invention of Examples 1 to 4 as described above, the base oil does not become easily in contact with metal surface. Accordingly, the metal parts are less active catalytically in cleaving some bonds in the molecular structure of the organic compound constituting the base oil. Consequently, vaporization of the base oil associated with its degradation is suppressed. Most of the volatile lubricant components derive from the base oil, and thus, suppression of the vaporization of the base oil leads to reduction in the vaporized amount of lubricant. Although DOS was used as base oil in the present Example, similar advantageous effects are obtained with other ester compounds such as polyol ester or with the base oil described above.

Example 5

Figure 3:
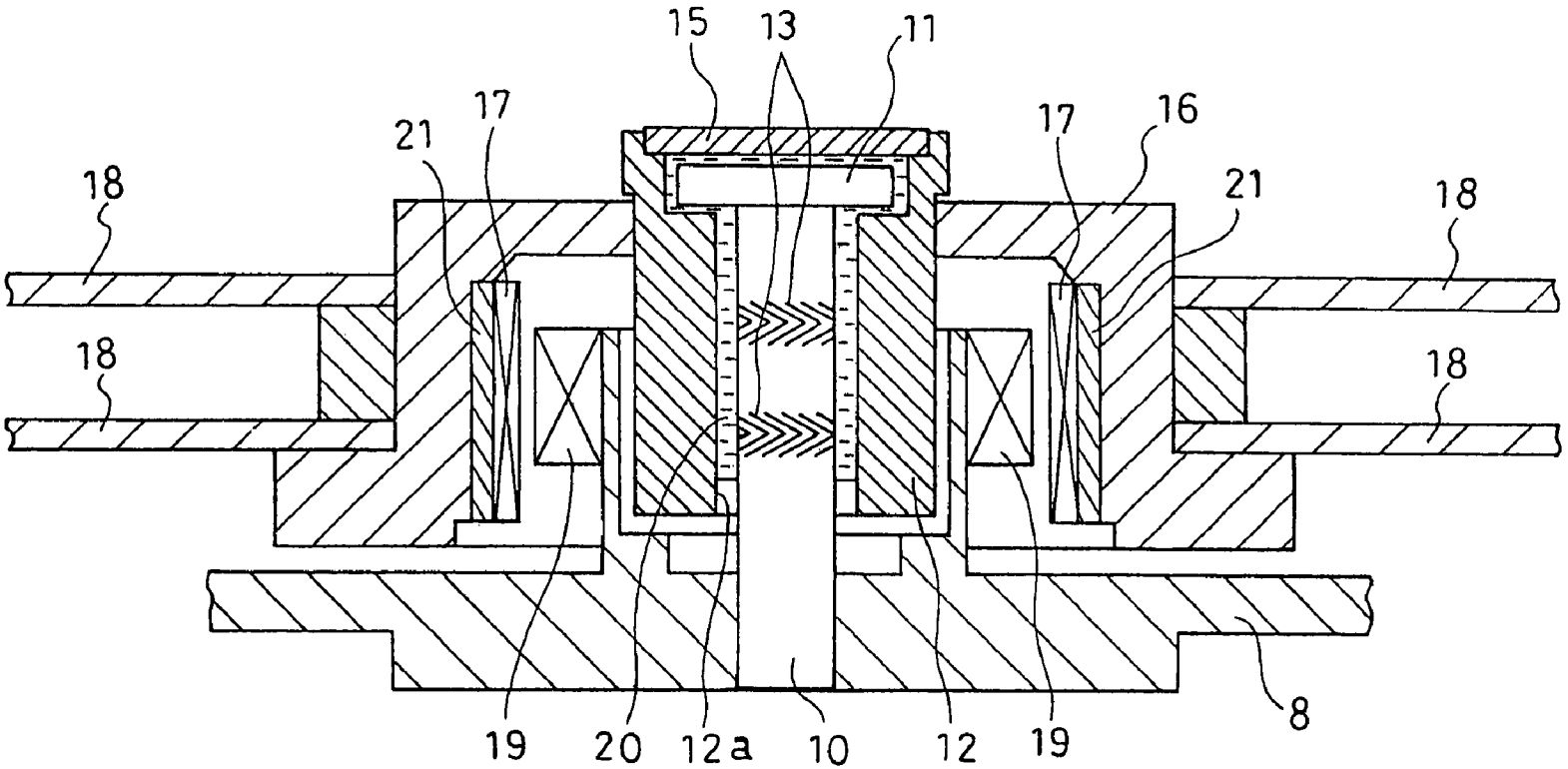
FIG. 3 is a sectional view illustrating the main area of a spindle motor filled with the lubricant according to the present invention.

Example 5 relates to a spindle motor using the lubricants of Examples 1 to 4 above, and the cross section of its main region is shown in FIG. 3. A hard disk drive is configured by placing a particular number of magnetic disks 18 on the spindle motor shown in FIG. 3.

One end of the shaft 10 of the spindle motor shown in FIG. 3 is fixed on a base plate 8. A thrust flange 11 is connected to the other end of the shaft 10. The shaft 10 is inserted in the bearing hole 12*a* of a sleeve 12. The space in the sleeve 12 including the thrust flange 11 is sealed tightly with a thrust plate 15.

Radial dynamic-pressure-generating grooves 13 are formed at least on the external surface of shaft 10 or the internal surface of bearing hole 12*a*. In addition, thrust dynamic-pressure-generating grooves (not shown in Figure) are formed on at least one of the thrust flange 11, thrust plate 15, and the stage area of the sleeve 12. A hub 16 is connected to the sleeve 12. A back yoke 21 and a rotor magnet 17 are connected to the internal surface of the hub 16. A stator coil 19 is connected to the base 8 with the coil facing the rotor magnet 17.

At least one of the lubricants 20 according to the present invention of Examples 1 to 4 is filled in the space between the shaft 10 and the bearing hole 12*a* of sleeve 12 and between the thrust flange 11 and the thrust plate 15.

When power is applied to the stator coil 19, the sleeve 12, hub 16 and magnetic disk 18 rotate by the driving force generated in the rotor magnet 17. The rotation generates a dynamic pressure in the lubricant, and the sleeve 12 and the thrust plate 15 rotate not in contact with the shaft 10 and the thrust flange 11.

Although the spindle motor shown in FIG. 3 has a common shaft-fixed fluid dynamic bearing, the lubricant according to the present invention is applicable to fluid dynamic bearing in any form or shape including shaft-rotating fluid dynamic bearing; and it is possible even in such cases to obtain the advantageous effects of reducing the wear loss of bearing parts and the amount of evaporation of lubricant, as shown in FIGS. 1 and 2.

INDUSTRIAL APPLICABILITY

The present invention is applicable as a fluid dynamic bearing for small-sized and long-life spindle motor.

The invention claimed is:

1. A lubricant, comprising:
a base oil as primary lubricant component, and
a naphthenate salt as additive (A) and
an alkylimidazole compound as additive (B),
added to the base oil,
wherein the amount of the additive (A) is in the range of 0.1 to 5 wt %, and the amount of the additive (B) is in the range of 0.01 to 2 wt %.

2. The lubricant according to claim 1, wherein the additive (B) is a 2-straight-chain-alkylimidazole compound.

3. The lubricant according to claim 1, wherein the additive (A) is zinc naphthenate, and the additive (B) is 2-undecylimidazole.

4. The lubricant according to claim 1, wherein the amount of the additive (A) is in the range of 0.5 to 2 wt % and the amount of the additive (B) is in the range of 0.05 to 0.5 wt %.

5. A lubricant, comprising:
a base oil as primary lubricant component, and
a naphthenate salt as additive (A),
an alkylimidazole compound as additive (B), and
an aliphatic amine compound as additive (C),
added to the base oil,
wherein the amount of the additive (A) is in the range of 0.1 to 5 wt %, the amount of the additive (B) is in the range of 0.01 to 2 wt %, and the amount of the additive (C) is in the range of 0.01 to 2 wt %.

6. The lubricant according to claim 5, wherein the additive (B) is a 2-straight-chain-alkylimidazole compound, and the additive (C) is a primary amine compound.

7. The lubricant according to claim 5, wherein the additive (A) is zinc naphthenate, the additive (B) is 2-undecylimidazole, and the additive (C) is octadecylamine.

8. The lubricant according to claim 5, wherein the amount of the additive (A) is in the range of 0.5 to 2 wt %, the amount of the additive (B) is in the range of 0.05 to 0.5 wt %, and the amount of the additive (C) is in the range of 0.05 to 0.5 wt %.

9. The lubricant according to claim 1, wherein the base oil is at least one compound selected from poly-α-olefin compound, ester compound, ether compound, fluorine compound, and alkylbenzene compound.

10. The lubricant according to claim 1, further comprising an antioxidant added to the base oil.

11. A method of lubricating a fluid dynamic bearing, comprising introducing the lubricant according to claim 1 in the fluid dynamic bearing.

12. A fluid dynamic bearing, comprising the lubricant according to claim 1 filled therein.

13. A spindle motor, comprising the fluid dynamic bearing according to claim 12.

14. A magnetic disk device, comprising the spindle motor according to claim 13.

15. A method of lubricating a fluid dynamic bearing, comprising introducing the lubricant according to claim 5 in the fluid dynamic bearing.

16. A fluid dynamic bearing, comprising the lubricant according to claim 5 filled therein.

17. A spindle motor, comprising the fluid dynamic bearing according to claim 16.

18. A magnetic disk device, comprising the spindle motor according to claim 17.

* * * * *